US010876075B2

(12) United States Patent
Hulskotter et al.

(10) Patent No.: US 10,876,075 B2
(45) **Date of Patent: *Dec. 29, 2020**

(54) CLEANING COMPOSITION

(71) Applicant: The Procter & Gamble Company, Cincinnati, OH (US)

(72) Inventors: Frank Hulskotter, Bad Duerkheim (DE); Patrick Firmin August Delplancke, Steenhuize-Wijnhuize (BE); Bjoern Ludolph, Ludwigshafen (DE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/641,624

(22) Filed: Jul. 5, 2017

(65) Prior Publication Data

US 2017/0306268 A1 Oct. 26, 2017

Related U.S. Application Data

(63) Continuation of application No. 14/700,194, filed on Apr. 30, 2015, now Pat. No. 9,725,682.

(30) Foreign Application Priority Data

Apr. 30, 2014 (EP) ..... 14166720

(51) Int. Cl.

| | |
|---|---|
| ***C11D 1/29*** | (2006.01) |
| ***C11D 1/75*** | (2006.01) |
| ***C11D 1/83*** | (2006.01) |
| ***C11D 3/30*** | (2006.01) |
| ***C11D 1/94*** | (2006.01) |
| ***C11D 3/04*** | (2006.01) |
| ***C11D 3/33*** | (2006.01) |
| ***C11D 1/88*** | (2006.01) |
| ***C11D 1/37*** | (2006.01) |
| ***C11D 1/66*** | (2006.01) |
| ***C11D 3/18*** | (2006.01) |
| ***C11D 1/72*** | (2006.01) |
| ***C11D 3/37*** | (2006.01) |

(52) U.S. Cl.

CPC ..... *C11D 3/30* (2013.01); *C11D 1/29* (2013.01); *C11D 1/37* (2013.01); *C11D 1/66* (2013.01); *C11D 1/72* (2013.01); *C11D 1/75* (2013.01); *C11D 1/83* (2013.01); *C11D 1/88* (2013.01); *C11D 1/94* (2013.01); *C11D 3/04* (2013.01); *C11D 3/046* (2013.01); *C11D 3/185* (2013.01); *C11D 3/33* (2013.01); *C11D 3/3723* (2013.01)

(58) Field of Classification Search

CPC .... C11D 1/29; C11D 1/72; C11D 1/75; C11D 3/30; C11D 3/3723; C11D 3/33; C11D 1/88; C11D 1/94; B08B 3/08

USPC ..... 510/237, 424, 427, 475, 477, 488, 499, 510/503; 134/39, 40

See application file for complete search history.

(56) References Cited

U.S. PATENT DOCUMENTS

| | | | | |
|---|---|---|---|---|
| 2,509,197 | A | 5/1950 | Ben Borus et al. | |
| 5,827,813 | A * | 10/1998 | Hartman | C11D 1/40 510/443 |
| 5,990,065 | A | 11/1999 | Vinson et al. | |
| 6,069,122 | A | 5/2000 | Vinson et al. | |
| 6,156,720 | A * | 12/2000 | Boeckh | C11D 3/0036 510/475 |
| 6,300,304 | B1 * | 10/2001 | Boeckh | C11D 3/0036 510/475 |

(Continued)

FOREIGN PATENT DOCUMENTS

| | | |
|---|---|---|
| EP | 0 232 092 A2 | 8/1987 |
| EP | 0 647 706 A2 | 4/1995 |

(Continued)

OTHER PUBLICATIONS

Baxxodur ECX 210, BASF The Chemical Company, p. 1.*
English Language translation of JPH07292388, Kondo et al, Cleaning of Magnetic Head, p. 1-10, Nov. 1995.*
Extended European Search Report; Application No. 14166723.8; date of search Oct. 9, 2014; 5 pages.

(Continued)

*Primary Examiner* — Gregory R Delcotto
(74) *Attorney, Agent, or Firm* — Melissa Krasovec

(57) ABSTRACT

A hard surface cleaning composition comprising:

a) from about 1% to about 60% by weight of the composition of a surfactant system, wherein said surfactant system comprises an anionic surfactant and amphoteric/zwitterionic system wherein the amphoteric to zwitterionic weight ratio is from about 2:1 to about 1:2, wherein said amphoteric surfactant comprises an alkyl dimethyl amine oxide; and b) from about 0.1% to about 10% by weight of the composition of a cleaning amine of Formula(I):

(I)

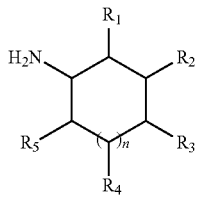

wherein the radicals $R_1$, $R_2$, $R_3$, $R_4$ and $R_5$ are independently selected from NH2, —H, linear or branched alkyl or alkenyl having from about 1 to about 10 carbon atoms and n is from 1 to 3 and wherein at least one of the radicals is NH2.

8 Claims, No Drawings

(56) References Cited

U.S. PATENT DOCUMENTS

| | | | | |
|---|---|---|---|---|
| 6,362,147 | B1 | 3/2002 | Castro et al. | |
| 6,710,023 | B1 | 3/2004 | Bodet et al. | |
| 6,774,099 | B1 * | 8/2004 | Scheibel | C11D 1/83 510/357 |
| 8,318,653 | B2 * | 11/2012 | Misske | C08G 73/0206 510/360 |
| 9,725,682 | B2 * | 8/2017 | Hulskotter | C11D 1/94 |
| 2010/0261634 | A1 * | 10/2010 | Misske | C08G 73/0206 510/299 |
| 2014/0121147 | A1 * | 5/2014 | Tajmamet | C11D 3/48 510/235 |
| 2014/0174478 | A1 * | 6/2014 | Letzelter | C11D 1/831 134/25.2 |
| 2014/0290694 | A1 * | 10/2014 | Uchiyama | C11D 1/12 134/6 |
| 2014/0323380 | A1 * | 10/2014 | Tajmamet | C11D 3/48 510/235 |
| 2015/0191681 | A1 * | 7/2015 | Gonzales | C11D 3/227 510/441 |
| 2015/0315573 | A1 * | 11/2015 | Monteleone | C12N 15/113 514/44 A |
| 2017/0015943 | A1 * | 1/2017 | Braeckman | C11D 3/30 |
| 2017/0015948 | A1 * | 1/2017 | Johnson | C11D 3/40 |
| 2017/0015949 | A1 * | 1/2017 | Johnson | C11D 3/42 |
| 2017/0015951 | A1 * | 1/2017 | Johnson | C11D 1/83 |
| 2017/0306268 | A1 * | 10/2017 | Hulskotter | C11D 3/30 |

FOREIGN PATENT DOCUMENTS

| | | | |
|---|---|---|---|
| EP | 0 921 164 | A1 | 6/1999 |
| JP | 2905913 | * | 6/1999 |
| WO | WO 99/11746 | A1 | 3/1999 |
| WO | WO99/27054 | * | 6/1999 |
| WO | WO 99/63034 | A1 | 12/1999 |
| WO | WO00/63333 | * | 10/2000 |
| WO | WO 01/25379 | A1 | 4/2001 |
| WO | WO 01/76729 | A2 | 10/2001 |
| WO | WO 2012/011020 | A2 | 1/2012 |
| WO | WO 2012/126665 | A1 | 9/2012 |

OTHER PUBLICATIONS

Extended European Search Report; Application No. 14166724.6; date of search Oct. 7, 2014; 3 pages.
Extended European Search Report; Application No. 14166722.0; date of search Oct. 2, 2014; 3 pages.
Extended European Search Report; Application No. 14166720.4; date of search Dec. 9, 2014; 5 pages.

* cited by examiner

CLEANING COMPOSITION

FIELD OF THE INVENTION

The present invention is in the field of detergents. In particular, it relates to a cleaning composition, more in particular to a composition comprising a cleaning amine. The composition provides good cleaning, in particular good grease cleaning.

BACKGROUND OF THE INVENTION

Cooked-, baked- and burnt-on greasy soils are amongst the most severe types of soils to remove from surfaces. Traditionally, the removal of cooked-, baked- and burnt-on greasy soils from cookware and tableware requires soaking the soiled object prior to mechanical action. Manual dishwashing processes require a tremendous rubbing effort to remove cooked-, baked- and burnt-on greasy soils and this can be detrimental to the safety and condition of the cookware/tableware.

Another problem faced in manual dishwashing is grease removal, in particular grease removal from hydrophobic substrates such as plastics.

Users not only seek good cleaning but they also expect the washed items to be pleasant to the touch and not to be left feeling greasy to the touch during and after the rinse.

Hand dishwashing trends are changing. Traditionally, the washing up has been done in a sink full of water with the detergent diluted in it. Nowadays, the trend is towards the use of a cleaning implement, such as a sponge. The cleaning composition is dosed onto the sponge, before or after the sponge is wetted, a soiled item is then wiped and subsequently rinsed under running water. This new way of hand dishwashing, sometimes referred to as direct application, places the cleaning composition in a new environment that needs to be taken into account for the design of the composition. With the new preference of using direct application, there is a need to provide a cleaning composition that performs well under the new usage conditions.

SUMMARY OF THE INVENTION

According to the first aspect of the invention, there is provided a cleaning composition, preferably in liquid form. The composition comprises a surfactant system and a cleaning amine. The composition provides excellent polymerized grease removal from all types of hard surfaces. Preferably the composition is a hand dishwashing composition.

The surfactant system of the composition of the invention preferably comprises an anionic surfactant and a primary co-surfactant selected from the group consisting of amphoteric, zwitteronic and mixtures thereof. The composition can further comprise a non-ionic surfactant.

The anionic surfactant can be any anionic cleaning surfactant, especially preferred anionic surfactants are selected from the group consisting of alkyl sulfate, alkyl alkoxy sulfate, alkyl benzene sulfonate, paraffin sulfonate and mixtures thereof. Preferred anionic surfactants are selected from alkyl sulfate, alkyl alkoxy sulfate and mixtures thereof, a preferred alkyl alkoxy sulfate is alkyl ethoxy sulfate. Preferred anionic surfactant for use herein is a mixture of alkyl sulfate and alkyl ethoxy sulfate.

Extremely useful surfactant systems for use herein include those comprising anionic surfactants, in combination with amine oxide, especially alkyl dimethyl amine oxides, and/or betaine surfactants.

Another preferred surfactant system for use herein is an anionic and amphoteric/zwitterionic system in which the amphoteric to zwitterionic weight ratio is preferably from about 2:1 to about 1:2. In particular a system in which the amphoteric surfactant is an amine oxide surfactant and the zwitteronic surfactant is a betaine and the weight ratio of the amine oxide to the betaine is about 1:1.

Also preferred for use herein are surfactant systems further comprising non-ionic surfactants. Especially preferred nonionic surfactants are alkyl alkoxylated nonionic surfactants, especially alkyl ethoxylated surfactants.

Especially preferred surfactant systems for the composition of the invention comprise an anionic surfactant preferably selected from the group consisting of alkyl sulfate, alkyl alkoxy sulfate and mixtures thereof, more preferably an alkyl alkoxylated sulfate, and an amphoteric surfactant, preferably an amino oxide surfactant and a non-ionic surfactant. In summary, the most preferred surfactant system for use herein comprises an alkyl alkoxylated sulfate surfactant, amine oxide and non-ionic surfactant, especially an alkyl ethoxylated sulfate surfactant, alkyl dimethyl amine oxide and an alkyl ethoxylate nonionic surfactant.

The composition of the invention can further comprise a salt of a divalent cation. In particular, a salt of magnesium. It has been found that magnesium cations can work in combination with the cleaning amine by strengthening and broadening the grease cleaning profile of the composition.

The composition of the invention can further comprise a chelant. It has been found that chelants can act in combination with the cleaning amine of the invention to provide improved grease cleaning. Preferred chelants for use herein are aminophosphonate and aminocarboxylated chelants in particular aminocarboxylated chelants such as MGDA and GLDA.

According to the second aspect of the invention there is provided a method of manually washing dishware using the composition of the invention in neat form (direct application). The composition of the invention can also be used in diluted form (full sink), however greater benefits in terms of grease cleaning are obtained when the composition is directly applied on the soiled surface or on a cleaning implement, such as sponge, to be used to clean the soiled surface. There is also provided the use of the composition of the invention for the removal of greasy soils, in particular polymerized grease, in manual dishwashing.

DETAILED DESCRIPTION OF THE INVENTION

The present invention envisages a cleaning composition, preferably a hand dishwashing cleaning composition, comprising a surfactant system and a specific cleaning amine. The composition of the invention provides very good polymerized grease removal. The invention also envisages a method of hand dishwashing and use of the composition for the removal of greasy soils, in particular polymerized grease.

The Cleaning Composition

The cleaning composition is preferably a hand dishwashing cleaning composition, preferably in liquid form. It typically contains from 30% to 95%, preferably from 40% to 90%, more preferably from 50% to 85% by weight of a liquid carrier in which the other essential and optional components are dissolved, dispersed or suspended. One preferred component of the liquid carrier is water.

Preferably the pH of the composition is from about 6 to about 12, more preferably from about 7 to about 11 and most preferably from about 8 to about 10, as measured at 25° C. and 10% aqueous concentration in distilled water. The cleaning amine of the invention performs better at a pH of from 8 to 10. The pH of the composition can be adjusted using pH modifying ingredients known in the art.

Cleaning Amine

The composition of the invention includes from about 0.1% to about 10%, preferably, from about 0.2% to about 5%, and more preferably, from about 0.5% to about 4%, by weight of the composition, of a cleaning amine.

By "cleaning amine" is herein meant a molecule, having the formula depicted herein below, comprising amine functionalities that helps cleaning as part of a cleaning composition.

The cleaning amine of the invention conforms to the following formula:

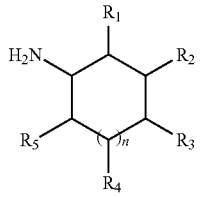

The substituents "Rs" can be independently selected from NH2, H and linear, branched alkyl or alkenyl from 1 to 10 carbon atoms. For the purpose of this invention "Rs" includes R1-R5. At least one of the "Rs" needs to be NH2. The remaining "Rs" can be independently selected from NH2, H and linear, branched alkyl or alkenyl having from 1 to 10 carbon atoms. n is from 0 to 3, preferably 1.

The amine of the invention is a cyclic amine with at least two primary amine functionalities. The primary amines can be in any position in the cycle but it has been found that in terms of grease cleaning, better performance is obtained when the primary amines are in positions 1,3. It has also been found advantageous in terms of grease cleaning amines in which one of the substituents is —CH3 and the rest are H.

The term "cleaning amine" herein encompasses a single cleaning amine and a mixture thereof.

The amine can be subjected to protonation depending on the pH of the cleaning medium in which it is used.

Surfactant System

The cleaning composition comprises from about 1% to about 60%, preferably from about 5% to about 50% more preferably from about 8% to about 40% by weight thereof of a surfactant system. The surfactant system preferably comprises an anionic surfactant, more preferably an anionic surfactant selected from the group consisting of alkyl sulfate, alkyl alkoxy surfate, especially alkyl ethoxy sulfate, alkyl benzene sulfonate, paraffin sulfonate and mixtures thereof. The system also comprises an amphoteric, and/or zwitterionic surfactant and optionally a non-ionic surfactant.

Alkyl sulfates are preferred for use herein, especially alkyl ethoxy sulfates; more preferably a combination of alkyl sulfates and alkyl ethoxy sulfates with a combined average ethoxylation degree of less than 5, preferably less than 3, more preferably less than 2 and more than 0.5 and an average level of branching of from about 5% to about 40%.

The composition of the invention preferably comprises an amphoteric and/or zwitterionic surfactant, preferably the amphoteric surfactant comprises an amine oxide, preferably an alkyl dimethyl amine oxide, and the zwitteronic surfactant comprises a betaine surfactant.

The most preferred surfactant system for the detergent composition of the present invention comprise from 1% to 40%, preferably 6% to 35%, more preferably 8% to 30% weight of the total composition of an anionic surfactant, preferably an alkyl alkoxy sulfate surfactant, more preferably an alkyl ethoxy sulfate, combined with 0.5% to 15%, preferably from 1% to 12%, more preferably from 2% to 10% by weight of the composition of amphoteric and/or zwitterionic surfactant, more preferably an amphoteric and even more preferably an amine oxide surfactant, especially and alkyl dimethyl amine oxide. Preferably the composition further comprises a nonionic surfactant, especially an alcohol alkoxylate in particular and alcohol ethoxylate nonionic surfactant. It has been found that such surfactant system in combination with the amine of the invention provides excellent grease cleaning and good finish of the washed items.

Anionic Surfactant

Anionic surfactants include, but are not limited to, those surface-active compounds that contain an organic hydrophobic group containing generally 8 to 22 carbon atoms or generally 8 to 18 carbon atoms in their molecular structure and at least one water-solubilizing group preferably selected from sulfonate, sulfate, and carboxylate so as to form a water-soluble compound. Usually, the hydrophobic group will comprise a C 8-C 22 alkyl, or acyl group. Such surfactants are employed in the form of water-soluble salts and the salt-forming cation usually is selected from sodium, potassium, ammonium, magnesium and mono-, di- or tri-C 2-C 3 alkanolammonium, with the sodium, cation being the usual one chosen.

The anionic surfactant can be a single surfactant but usually it is a mixture of anionic surfactants. Preferably the anionic surfactant comprises a sulfate surfactant, more preferably a sulfate surfactant selected from the group consisting of alkyl sulfate, alkyl alkoxy sulfate and mixtures thereof. Preferred alkyl alkoxy sulfates for use herein are alkyl ethoxy sulfates.

Sulfated Anionic Surfactant

Preferably the sulfated anionic surfactant is alkoxylated, more preferably, an alkoxylated branched sulfated anionic surfactant having an alkoxylation degree of from about 0.2 to about 4, even more preferably from about 0.3 to about 3, even more preferably from about 0.4 to about 1.5 and especially from about 0.4 to about 1. Preferably, the alkoxy group is ethoxy. When the sulfated anionic surfactant is a mixture of sulfated anionic surfactants, the alkoxylation degree is the weight average alkoxylation degree of all the components of the mixture (weight average alkoxylation degree). In the weight average alkoxylation degree calculation the weight of sulfated anionic surfactant components not having alkoxylated groups should also be included.

$$\text{Weight average alkoxylation degree} = (x1 * \text{alkoxylation degree of surfactant } 1 + x2 * \text{alkoxylation degree of surfactant } 2 + \ldots)/(x1 + x2 + \ldots)$$

wherein x1, x2, . . . are the weights in grams of each sulfated anionic surfactant of the mixture and alkoxylation degree is the number of alkoxy groups in each sulfated anionic surfactant.

Preferably, the branching group is an alkyl. Typically, the alkyl is selected from methyl, ethyl, propyl, butyl, pentyl, cyclic alkyl groups and mixtures thereof. Single or multiple alkyl branches could be present on the main hydrocarbyl chain of the starting alcohol(s) used to produce the sulfated anionic surfactant used in the detergent of the invention.

Most preferably the branched sulfated anionic surfactant is selected from alkyl sulfates, alkyl ethoxy sulfates, and mixtures thereof.

The branched sulfated anionic surfactant can be a single anionic surfactant or a mixture of anionic surfactants. In the case of a single surfactant the percentage of branching refers to the weight percentage of the hydrocarbyl chains that are branched in the original alcohol from which the surfactant is derived.

In the case of a surfactant mixture the percentage of branching is the weight average and it is defined according to the following formula:

Weight average of branching (%)=[(*x*1*wt % branched alcohol 1 in alcohol 1+*x*2*wt % branched alcohol 2 in alcohol 2+ . . . )/(*x*1+*x*2+ . . . )]*100 wherein x1, x2, . . . are the weight in grams of each alcohol in the total alcohol mixture of the alcohols which were used as starting material for the anionic surfactant for the detergent of the invention. In the weight average branching degree calculation the weight of anionic surfactant components not having branched groups should also be included.

Suitable sulfate surfactants for use herein include water-soluble salts of C8-C18 alkyl or hydroxyalkyl, sulfate and/or ether sulfate. Suitable counterions include alkali metal cation or ammonium or substituted ammonium, but preferably sodium.

The sulfate surfactants may be selected from C8-C18 primary, branched chain and random alkyl sulfates (AS); C8-C18 secondary (2,3) alkyl sulfates; C8-C18 alkyl alkoxy sulfates (AExS) wherein preferably x is from 1-30 in which the alkoxy group could be selected from ethoxy, propoxy, butoxy or even higher alkoxy groups and mixtures thereof.

Alkyl sulfates and alkyl alkoxy sulfates are commercially available with a variety of chain lengths, ethoxylation and branching degrees. Commercially available sulfates include, those based on Neodol alcohols ex the Shell company, Lial-Isalchem and Safol ex the Sasol company, natural alcohols ex The Procter & Gamble Chemicals company.

Preferably, the anionic surfactant comprises at least 50%, more preferably at least 60% and especially at least 70% of a sulfate surfactant by weight of the anionic surfactant. Especially preferred detergents from a cleaning view point are those in which the anionic surfactant comprises more than 50%, more preferably at least 60% and especially at least 70% by weight thereof of sulfate surfactant and the sulfate surfactant is selected from the group consisting of alkyl sulfates, alkyl ethoxy sulfates and mixtures thereof. Even more preferred are those in which the anionic surfactant is an alkyl ethoxy sulfate with a degree of ethoxylation of from about 0.2 to about 3, more preferably from about 0.3 to about 2, even more preferably from about 0.4 to about 1.5, and especially from about 0.4 to about 1. They are also preferred anionic surfactant having a level of branching of from about 5% to about 40%, even more preferably from about 10% to 35% and especially from about 20% to 30%.

Sulphonate Surfactant

Suitable sulphonate surfactants for use herein include water-soluble salts of C8-C18 alkyl or hydroxyalkyl sulphonates; C11-C18 alkyl benzene sulphonates (LAS), modified alkylbenzene sulphonate (MLAS) as discussed in WO 99/05243, WO 99/05242, WO 99/05244, WO 99/05082, WO 99/05084, WO 99/05241, WO 99/07656, WO 00/23549, and WO 00/23548; methyl ester sulphonate (MES); and alpha-olefin sulphonate (AOS). Those also include the paraffin sulphonates may be monosulphonates and/or disulphonates, obtained by sulphonating paraffins of 10 to 20 carbon atoms. The sulfonate surfactant also include the alkyl glyceryl sulphonate surfactants.

Non Ionic Surfactant

Nonionic surfactant, when present, is comprised in a typical amount of from 0.1% to 40%, preferably 0.2% to 20%, most preferably 0.5% to 10% by weight of the composition. Suitable nonionic surfactants include the condensation products of aliphatic alcohols with from 1 to 25 moles of ethylene oxide. The alkyl chain of the aliphatic alcohol can either be straight or branched, primary or secondary, and generally contains from 8 to 22 carbon atoms. Particularly preferred are the condensation products of alcohols having an alkyl group containing from 10 to 18 carbon atoms, preferably from 10 to 15 carbon atoms with from 2 to 18 moles, preferably 2 to 15, more preferably 5-12 of ethylene oxide per mole of alcohol. Highly preferred nonionic surfactants are the condensation products of guerbet alcohols with from 2 to 18 moles, preferably 2 to 15, more preferably 5-12 of ethylene oxide per mole of alcohol.

Other suitable non-ionic surfactants for use herein include fatty alcohol polyglycol ethers, alkylpolyglucosides and fatty acid glucamides.

Amphoteric Surfactant

Preferred amine oxides are alkyl dimethyl amine oxide or alkyl amido propyl dimethyl amine oxide, more preferably alkyl dimethyl amine oxide and especially coco dimethyl amino oxide. Amine oxide may have a linear or mid-branched alkyl moiety. Typical linear amine oxides include water-soluble amine oxides containing one R1 C8-18 alkyl moiety and 2 R2 and R3 moieties selected from the group consisting of C1-3 alkyl groups and C1-3 hydroxyalkyl groups. Preferably amine oxide is characterized by the formula R1-N(R2)(R3) O wherein R1 is a C8-18 alkyl and R2 and R3 are selected from the group consisting of methyl, ethyl, propyl, isopropyl, 2-hydroxethyl, 2-hydroxypropyl and 3-hydroxypropyl. The linear amine oxide surfactants in particular may include linear C10-C18 alkyl dimethyl amine oxides and linear C8-C12 alkoxy ethyl dihydroxy ethyl amine oxides. Preferred amine oxides include linear C10, linear C10-C12, and linear C12-C14 alkyl dimethyl amine oxides. As used herein "mid-branched" means that the amine oxide has one alkyl moiety having n1 carbon atoms with one alkyl branch on the alkyl moiety having n2 carbon atoms. The alkyl branch is located on the a carbon from the nitrogen on the alkyl moiety. This type of branching for the amine oxide is also known in the art as an internal amine oxide. The total sum of n1 and n2 is from 10 to 24 carbon atoms, preferably from 12 to 20, and more preferably from 10 to 16. The number of carbon atoms for the one alkyl moiety (n1) should be approximately the same number of carbon atoms as the one alkyl branch (n2) such that the one alkyl moiety and the one alkyl branch are symmetric. As used herein "symmetric" means that $|n1-n2|$ is less than or equal to 5, preferably 4, most preferably from 0 to 4 carbon atoms in at least 50 wt %, more preferably at least 75 wt % to 100 wt % of the mid-branched amine oxides for use herein.

The amine oxide further comprises two moieties, independently selected from a C1-3 alkyl, a C1-3 hydroxyalkyl group, or a polyethylene oxide group containing an average of from about 1 to about 3 ethylene oxide groups. Preferably the two moieties are selected from a C1-3 alkyl, more preferably both are selected as a C1 alkyl.

Zwitterionic Surfactant

Other suitable surfactants include betaines, such as alkyl betaines, alkylamidobetaine, amidazoliniumbetaine, sulfobetaine (INCI Sultaines) as well as the Phosphobetaine and preferably meets formula (I):

$$R1\text{-}[CO\text{—}X(CH2)n]x\text{-}N+(R2)(R3)\text{-}(CH2)m\text{-}[CH(OH)\text{—}CH2]y\text{-}Y\text{—} \quad (I)$$

wherein

R1 is a saturated or unsaturated C6-22 alkyl residue, preferably C8-18 alkyl residue, in particular a saturated C10-16 alkyl residue, for example a saturated C12-14 alkyl residue;

X is NH, NR4 with C1-4 Alkyl residue R4, O or S, n a number from 1 to 10, preferably 2 to 5, in particular 3, x 0 or 1, preferably 1, R2, R3 are independently a C1-4 alkyl residue, potentially hydroxy substituted such as a hydroxyethyl, preferably a methyl.

m a number from 1 to 4, in particular 1, 2 or 3, y 0 or 1 and

Y is COO, SO3, OPO(OR5)O or P(O)(OR5)O, whereby R5 is a hydrogen atom H or a C1-4 alkyl residue.

Preferred betaines are the alkyl betaines of the formula (Ia), the alkyl amido propyl betaine of the formula (Ib), the Sulfo betaines of the formula (Ic) and the Amido sulfobetaine of the formula (Id);

$$R1\text{-}N+(CH3)2\text{-}CH2COO\text{—} \quad (Ia)$$

$$R1\text{-}CO\text{—}NH(CH2)3\text{-}N+(CH3)2\text{-}CH2COO\text{—} \quad (Ib)$$

$$R1\text{-}N+(CH3)2\text{-}CH2CH(OH)CH2SO3\text{-} \quad (Ic)$$

$$R1\text{-}CO\text{—}NH\text{—}(CH2)3\text{-}N+(CH3)2\text{-}CH2CH(OH)CH2SO3\text{-} \quad (Id)$$

in which R11 as the same meaning as in formula I. Particularly preferred betaines are the Carbobetaine [wherein Y——COO—], in particular the Carbobetaine of the formula (Ia) and (Ib), more preferred are the Alkylamidobetaine of the formula (Ib).

Examples of suitable betaines and sulfobetaine are the following [designated in accordance with INCI]: Almondamidopropyl of betaines, Apricotam idopropyl betaines, Avocadamidopropyl of betaines, Babassuamidopropyl of betaines, Behenam idopropyl betaines, Behenyl of betaines, betaines, Canolam idopropyl betaines, Capryl/Capram idopropyl betaines, Carnitine, Cetyl of betaines, Cocamidoethyl of betaines, Cocam idopropyl betaines, Cocam idopropyl Hydroxysultaine, Coco betaines, Coco Hydroxysultaine, Coco/Oleam idopropyl betaines, Coco Sultaine, Decyl of betaines, Dihydroxyethyl Oleyl Glycinate, Dihydroxyethyl Soy Glycinate, Dihydroxyethyl Stearyl Glycinate, Dihydroxyethyl Tallow Glycinate, Dimethicone Propyl of PG-betaines, Erucam idopropyl Hydroxysultaine, Hydrogenated Tallow of betaines, Isostearam idopropyl betaines, Lauram idopropyl betaines, Lauryl of betaines, Lauryl Hydroxysultaine, Lauryl Sultaine, Milkam idopropyl betaines, Minkamidopropyl of betaines, Myristam idopropyl betaines, Myristyl of betaines, Oleam idopropyl betaines, Oleam idopropyl Hydroxysultaine, Oleyl of betaines, Olivamidopropyl of betaines, Palmam idopropyl betaines, Palm itam idopropyl betaines, Palmitoyl Carnitine, Palm Kernelam idopropyl betaines, Polytetrafluoroethylene Acetoxypropyl of betaines, Ricinoleam idopropyl betaines, Sesam idopropyl betaines, Soyam idopropyl betaines, Stearam idopropyl betaines, Stearyl of betaines, Tallowam idopropyl betaines, Tallowam idopropyl Hydroxysultaine, Tallow of betaines, Tallow Dihydroxyethyl of betaines, Undecylenam idopropyl betaines and Wheat Germam idopropyl betaines.

A preferred betaine is, for example, Cocoamidopropylbetaine.

Divalent Cation

When utilized in the composition of the invention, divalent cations such as calcium and magnesium ions, preferably magnesium ions, are preferably added as a hydroxide, chloride, acetate, sulfate, formate, oxide, lactate or nitrate salt to the compositions of the present invention, typically at an active level of from 0.01% to 1.5%, preferably from 0.015% to 1%, more preferably from 0.025% to 0.5%, by weight of the composition.

Chelant

The composition herein may optionally further comprise a chelant at a level of from 0.1% to 20%, preferably from 0.2% to 5%, more preferably from 0.2% to 3% by weight of the composition.

As commonly understood in the detergent field, chelation herein means the binding or complexation of a bi- or multi-dentate ligand. These ligands, which are often organic compounds, are called chelants, chelators, chelating agents, and/or sequestering agent. Chelating agents form multiple bonds with a single metal ion. Chelants, are chemicals that form soluble, complex molecules with certain metal ions, inactivating the ions so that they cannot normally react with other elements or ions to produce precipitates or scale, or destabilizing soils facilitating their removal accordingly. The ligand forms a chelate complex with the substrate. The term is reserved for complexes in which the metal ion is bound to two or more atoms of the chelant.

Suitable chelating agents can be selected from the group consisting of amino carboxylates, amino phosphonates, polyfunctionally-substituted aromatic chelating agents and mixtures thereof.

Amino carboxylates include ethylenediaminetetra-acetates, N-hydroxyethylethylenediaminetriacetates, nitrilotriacetates, ethylenediamine tetraproprionates, triethylenetetraaminehexacetates, diethylenetriaminepentaacetates, and ethanoldiglycines, alkali metal, ammonium, and substituted ammonium salts therein and mixtures therein, as well as MGDA (methyl-glycine-diacetic acid), and salts and derivatives thereof and GLDA (glutamic-N,N-diacetic acid) and salts and derivatives thereof. GLDA (salts and derivatives thereof) is especially preferred according to the invention, with the tetrasodium salt thereof being especially preferred.

Other suitable chelants include amino acid based compound or a succinate based compound. The term "succinate based compound" and "succinic acid based compound" are used interchangeably herein. Other suitable chelants are described in U.S. Pat. No. 6,426,229. Particular suitable chelants include; for example, aspartic acid-N-monoacetic acid (ASMA), aspartic acid-N,N-diacetic acid (ASDA), aspartic acid-N-monopropionic acid (ASMP), iminodisuccinic acid (IDS), Imino diacetic acid (IDA), N-(2-sulfomethyl) aspartic acid (SMAS), N-(2-sulfoethyl) aspartic acid (SEAS), N-(2-sulfomethyl) glutamic acid (SMGL), N-(2-sulfoethyl) glutamic acid (SEGL), N-methyliminodiacetic acid (MIDA), alanine-N,N-diacetic acid (ALDA), serine-N,N-diacetic acid (SEDA), isoserine-N,N-diacetic acid (ISDA), phenylalanine-N,N-diacetic acid (PHDA), anthranilic acid-N,N-diacetic acid (ANDA), sulfanilic acid-N,N-diacetic acid (SLDA), taurine-N, N-diacetic acid (TUDA) and sulfomethyl-N,N-diacetic acid (SMDA) and alkali metal salts or ammonium salts thereof. Also suitable is ethylenediamine disuccinate ("EDDS"), especially the [S,S] isomer as described in U.S. Pat. No. 4,704,233. Furthermore, Hydroxyethyleneiminodiacetic acid, Hydroxyiminodisuccinic acid, Hydroxyethylene diaminetriacetic acid are also suitable.

Other chelants include homopolymers and copolymers of polycarboxylic acids and their partially or completely neutralized salts, monomeric polycarboxylic acids and hydroxycarboxylic acids and their salts. Preferred salts of the abovementioned compounds are the ammonium and/or alkali metal salts, i.e. the lithium, sodium, and potassium salts, and particularly preferred salts are the sodium salts.

Suitable polycarboxylic acids are acyclic, alicyclic, heterocyclic and aromatic carboxylic acids, in which case they contain at least two carboxyl groups which are in each case separated from one another by, preferably, no more than two carbon atoms. Polycarboxylates which comprise two carboxyl groups include, for example, water-soluble salts of, malonic acid, (ethylenedioxy) diacetic acid, maleic acid, diglycolic acid, tartaric acid, tartronic acid and fumaric acid. Polycarboxylates which contain three carboxyl groups include, for example, water-soluble citrate. Correspondingly, a suitable hydroxycarboxylic acid is, for example, citric acid. Another suitable polycarboxylic acid is the homopolymer of acrylic acid. Preferred are the polycarboxylates end capped with sulfonates.

Amino phosphonates are also suitable for use as chelating agents and include ethylenediaminetetrakis (methylenephosphonates) as DEQUEST. Preferred are these amino phosphonates that do not contain alkyl or alkenyl groups with more than about 6 carbon atoms.

Polyfunctionally-substituted aromatic chelating agents are also useful in the compositions herein such as described in U.S. Pat. No. 3,812,044. Preferred compounds of this type are dihydroxydisulfobenzenes such as 1,2-dihydroxy-3,5-disulfobenzene.

Further suitable polycarboxylates chelants for use herein include citric acid, lactic acid, acetic acid, succinic acid, formic acid; all preferably in the form of a water-soluble salt. Other suitable polycarboxylates are oxodisuccinates, carboxymethyloxysuccinate and mixtures of tartrate monosuccinic and tartrate disuccinic acid such as described in U.S. Pat. No. 4,663,071.

The most preferred chelants for use in the present invention are selected from the group consisting of diethylenetetraamine pentaacetic acid (DTPA), MGDA, GLDA, citrate and mixtures thereof.

Preservatives

The composition of the invention preferably comprises a preservative. A preservative is a naturally occurring or synthetically produced substance that is added to detergent compositions to prevent decomposition by microbial growth or by undesirable chemical changes. Preservatives can be divided into two types, depending on their origin. Class I preservatives refers to those preservatives which are naturally occurring, everyday substances. Class II preservatives refer to preservatives which are synthetically manufactured. Most preferred preservatives for use in liquid detergent compositions include derivatives of isothiazolinones, including methylisothiazolinone, methylchloroisothiazolinone, octylisothiazolinone, 1,2-benzisothiazolinone, and mixtures thereof. Other non-limiting examples of preservatives typically used are phenoxyethanol, paraben derivatives such as methyl paraben and propyl paraben, imidazole derivatives, and aldehydes including glutaraldehyde.

The detergent composition herein may comprise a number of optional ingredients such as builders, conditioning polymers, cleaning polymers, surface modifying polymers, soil flocculating polymers, structurants, emollients, humectants, skin rejuvenating actives, enzymes, carboxylic acids, scrubbing particles, bleach and bleach activators, perfumes, malodor control agents, pigments, dyes, opacifiers, beads, pearlescent particles, microcapsules, antibacterial agents, enzymes and pH adjusters and buffering means or water or any other dilutents or solvents compatible with the formulation.

Method of Washing

The second aspect of the invention is directed to a method of washing dishware with the composition of the present invention. Said method comprises the step of applying the composition, preferably in liquid form, onto the dishware surface, either directly or by means of a cleaning implement, i.e., in neat form.

By "in its neat form", it is meant herein that said composition is not diluted in a full sink of water. The composition is applied directly onto the surface to be treated and/or onto a cleaning device or implement such as a dish cloth, a sponge or a dish brush without undergoing major dilution (immediately) prior to the application. The cleaning device or implement is preferably wet before or after the composition is delivered to it. Especially good polymerized grease removal has been found when the composition is used in neat form. The cleaning mechanism that takes place when compositions are used in neat form seems to be quite different to that taken place when compositions are used in diluted form.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

EXAMPLES

The removal of uncooked grease of hand dishwashing detergent compositions with and without amines according to the invention was evaluated. As it can be seen from the results below, compositions comprising the amines of the invention provide considerably greater grease removal than the same compositions without the amine.

Example 1

The following hand dishwashing detergent compositions were made:

TABLE 1

| Ingredients | Composition A | Composition B | Composition C | Composition D |
|---|---|---|---|---|
| AES | 17.68 | 17.68 | 20.53 | 20.53 |
| C12/14 dimethyl amineoxide | 2.01 | 2.01 | 4.11 | 4.11 |
| Nonionic surfactant | 0.32 | 0.32 | 0.37 | 0.37 |
| PPG 2000 | 0.50 | 0.50 | 0.50 | 0.50 |
| Ethanol | 1.00 | 1.00 | 1.00 | 1.00 |
| NaCl | 1.00 | 1.00 | 0.75 | 0.75 |
| Phenoxyethanol | 0.15 | 0.15 | 0.15 | 0.15 |
| Amine | — | 2.00 | — | 1.00 |

Dye, perfume and preservative
NaOH/HCl to pH 9 (10% in demin water)
Water to 100%
Numbers in weight % of the formula
AES: Alkyl ethoxy sulfate
PPG 2000: polypropylene glycol (Molecular Weight 2000)

Methodology

Grease (beef fat) is liquefied by heating and small amounts are put in small glass vials and left at 4° C. for at least 24 hours. The day before the test, the vials with the grease are put at 21° C. to equilibrate. 10% wash solutions (water hardness: 14 dH) of the hand dishwashing detergent compositions as shown in Table 1 are added to the vial containing the grease. Turbidity/absorbance of the wash solutions is measured over time at 25° C., under mild stirring conditions via a small overhead stirrer. Cleaning indexes are calculated with reference to the compositions free of amine (Composition A and C, respectively): (Absorbance of the test solution with amine/absorbance of the reference solution without amine)*100. The higher the absorbance and Cleaning Index, the better the grease cleaning performance of the composition.

Absorbances and Cleaning Indices after 2/5/15/20 Min

| Composition A | Composition B with 1,2-Diaminocyclo-hexane | Composition B with methyl 1,3-Diaminocyclo-hexane |
|---|---|---|
| 0.08/0.09/0.11/0.12<br>100/100/100/100 | 0.55/0.71/0.87/0.90<br>688/789/791/750 | 0.61/0.75/0.97/1.04<br>762/833/882/867 |

Absorbances and Cleaning Indices after 2/5/15/20 Min

| Composition C | Composition D with methyl 1,3-Diaminocyclohexane |
|---|---|
| 0.09/0.13/0.20/0.23<br>100/100/100/100 | 0.27/0.38/0.56/0.62<br>300/292/280/270 |

As it can be seen, the compositions according to the invention (Compositions B and D) perform better than the same compositions without the amine (Compositions A and C).

Example 2

The following hand dishwashing detergent compositions were made:

TABLE 2

| Ingredients | Composition E | Composition F |
|---|---|---|
| AES | 21.41 | 21.41 |
| C12/14 dimethyl amineoxide | 4.86 | 4.86 |
| Nonionic surfactant | 0.43 | 0.43 |
| PPG 2000 | 0.40 | 0.40 |
| Ethanol | 2.36 | 2.36 |
| NaCl | 0.80 | 0.80 |
| Phenoxyethanol | 0.15 | 0.15 |
| PEI polymer | 0.25 | 0.25 |
| Amine | — | 2.00 |

Dye, perfume and preservative
NaOH/HCl to pH 9 (10% in demin water)
Water to 100%
Numbers in weight % of the formula
PEI polymer: alkoxylated polyethyleneimine polymer Methodology Grease (beef fat) is liquefied by heating and polystyrene sticks coated with paraffin wax are dipped in the liquid grease, so that grease-covered sticks are obtained. The grease-covered sticks are stored at 4 C for minimum 24 hours. For measuring the grease cleaning performance of the compositions, the grease-covered sticks are placed over a slightly moving/swirling microplate containing 10% wash solutions of the compositions (water hardness: 14 dH). The grease-covered sticks are dipping into the test solutions without getting in contact with the walls or bottom of the microplate and are kept in the swirling test solutions during the wash time. The wash temperature is 30° C. The turbidity of the test solutions is quantified via measuring the absorbance of the test solutions and from the measured absorbance the cleaning index is calculated: (Absorbance of the test solution with amine/absorbance of the reference solution without amine)*100. The higher the Cleaning Index, the better the grease cleaning performance of the composition.

| | Average Absorbance at 15 min | Cleaning Index at 15 min |
|---|---|---|
| Composition E | 0.40 | 100 |
| Composition F with methyl 1,3-Diaminocyclohexane | 0.69 | 172 |
| Composition F with 1,3-Diaminocyclohexane | 0.63 | 158 |
| Composition F with 1,4-Diaminocyclohexane | 0.48 | 120 |

As it can be seen, the compositions according to the invention (Compositions F) perform better than the same composition without the amine (Composition E).

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A hard surface cleaning composition comprising:

a) from about 1% to about 60% by weight of the composition of a surfactant system, wherein said surfactant system comprises from about 8% to about 40% by weight of the composition of C8-C18 alkyl ethoxy sulfate with a degree of ethoxylation of from about 0.2 to about 3 and from about 2% to 15% by weight of the composition of C10-C14 alkyl dimethyl amine oxide; and b) from about 0.5% to about 5% by weight of the composition of a cleaning amine of Formula(I):

(I)

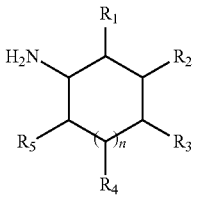

wherein R2 is NH2, one of R1, R3, R4 and R5 is CH3 and the remaining radicals are H and n is 1, wherein the pH of the composition is from about 7 to about 12, as measured at 25 degrees Celsius and 10% aqueous concentration in distilled water.

2. A composition according to claim 1 wherein the composition further comprises a non-ionic surfactant.

3. A composition according to claim 1 wherein the composition further comprises magnesium salt.

4. A composition according to claim 1 wherein the composition further comprises an aminocarboxylate chelant.

5. A composition according to claim 1 wherein the surfactant system further comprises a zwitteronic surfactant.

6. A composition according to claim 5 wherein the zwitteronic surfactant comprises a betaine surfactant.

7. A method of manually washing dishware comprising the step of applying a composition according to claim 1 directly onto the dishware or onto a cleaning implement, and using the cleaning implement to clean the dishware.

8. The method according to claim 7, wherein greasy soils are removed from said dishware.

* * * * *